United States Patent [19]

Belgian

[11] Patent Number: 4,792,392

[45] Date of Patent: Dec. 20, 1988

[54] DUMP GATE CONTROL SYSTEM

[75] Inventor: Brian Belgian, Witton Gilbert, England

[73] Assignee: Ben Johnson & Company Limited, York, England

[21] Appl. No.: 894,697

[22] Filed: Aug. 8, 1986

[30] Foreign Application Priority Data

Aug. 13, 1985 [GB] United Kingdom ..... 8520302

[51] Int. Cl.[4] ..... B07C 5/02; B07C 5/36

[52] U.S. Cl. ..... 209/3.3; 156/64; 156/378; 156/504; 209/564; 209/570; 209/698

[58] Field of Search ..... 209/3.1–3.3, 209/509, 546, 549, 552, 562–566, 567, 570, 698, 941; 83/27, 72, 80, 89, 106, 360–362, 365; 226/27, 45; 377/20, 47; 328/129.1; 156/64, 157, 378, 504

[56] References Cited

U.S. PATENT DOCUMENTS

| | | | |
|---|---|---|---|
| 2,675,916 | 4/1954 | Caston et al. | 209/563 |
| 2,873,855 | 2/1959 | McCormick | 209/566 |
| 3,159,068 | 12/1964 | Grant et al. | 83/106 |
| 3,543,929 | 12/1970 | Mattia et al. | 209/564 |
| 3,547,265 | 12/1970 | Braun et al. . | |
| 3,567,534 | 3/1971 | Kushiro | 156/64 |
| 3,710,936 | 1/1973 | Mizunuma . | |
| 3,967,994 | 7/1976 | Langberg | 156/64 |
| 4,147,620 | 4/1979 | Artiano et al. | 209/941 X |
| 4,166,246 | 8/1979 | Matt | 209/564 X |
| 4,172,525 | 10/1979 | Hams et al. | 209/564 |
| 4,234,365 | 11/1980 | Shimizu et al. | 156/64 |
| 4,237,374 | 12/1980 | Malone | 377/15 X |
| 4,314,757 | 2/1982 | Anderson et al. | 226/45 X |

FOREIGN PATENT DOCUMENTS

| | | | |
|---|---|---|---|
| 1080404 | 8/1967 | United Kingdom | 209/565 |

*Primary Examiner*—Robert B. Reeves
*Assistant Examiner*—Edward M. Wacyra
*Attorney, Agent, or Firm*—Wood, Dalton, Phillips Mason & Rowe

[57] ABSTRACT

A system for controlling a dump gate in a conveyor system (e.g. carrying printed copy from a high-speed printing press to stackers) detects a marker carried by a marred product (e.g. a metal tab fitted when splicing a new reel of paper) to start a counter which counts the products passing and opens the dump gate a predetermined count. A counter closes the dump gate again when a second predetermined count of passing products is reached.

10 Claims, 4 Drawing Sheets

DUMP GATE CONTROL SYSTEM

FIELD OF THE INVENTION

This invention relates to a system for controlling a "dump" gate in a conveyor system which is conveying successive products, and has particular utility in a high-speed printing press.

BACKGROUND AND SUMMARY OF THE INVENTION

In one form of high-speed printing press, a conveyor system carries printed copy from the press to automatic stackers. In these conveyors there is fitted a hinged section which can be dropped to divert the copy (to a waste conveyor running underneath) by closing a switch on the operator's console. This hinged section, or dump gate, is dropped whenever unsatisfactory copy is being printed, such as during "make ready" or when a splice is made on the incoming reels of paper.

An object of this invention is to provide a control system capable of dropping the dump gate automatically when a splice (marred by glue) is leaving the press, enabling this splice to be made at the press running speed.

In accordance with this invention, there is provided a system for controlling a dump gate in a conveyor system, comprising means for detecting a marker carried by a marred product in a succession of products being conveyed and to start a counter, and means for opening the dump gate once a predetermined number of said products has been counted as passing a predetermined point along the conveyor, and for closing the dump gate again once a further predetermined number of products has been counted past.

In an embodiment of control system to be described below, a metal tab is fitted to a new reel of paper when preparing the splice: once the splice has been made, the metal tab is detected on the press delivery conveyor immediately upstream of the dump gate. The number of copies passing is then counted and at a preset count the gate is lowered, then at a further preset number it is raised again. Complete control is thus achieved over the number of copies which are rejected and the gate is lowered only when the splice appears and closed immediately after the splice, regardless of the press and conveyor speed.

This embodiment of our control system includes two electronics counters, which are forced to respective preset counts (the pre-dump and end-dump copy counts) when the tab is detected. The two counters are then decremented by the successive copies passing, until the pre-dump counter reaches zero (whereupon a solenoid for opening the gate is energised) and then later the end-dump counter reaches zero (whereupon the dump solenoid is de-energised to allow the gate to close again).

BRIEF DESCRIPTION OF THE DRAWINGS

Said embodiment of this invention will now be described by way of example only and with reference to the accompanying drawings, in which.

DESCRIPTION OF THE PREFERRED EMBODIMENT

Figure 1:
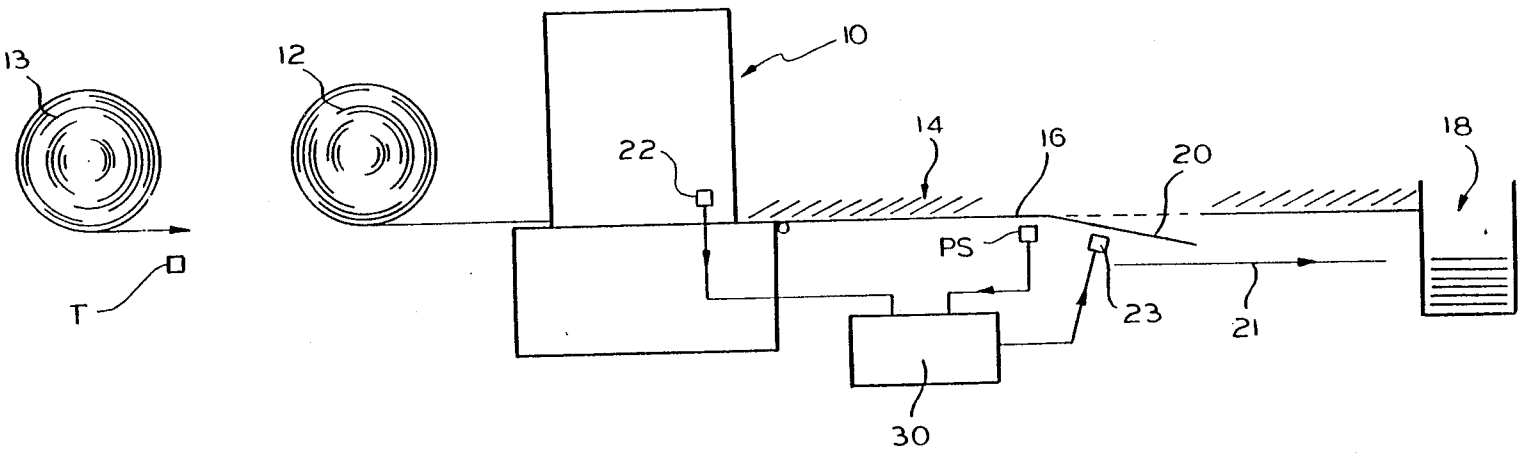
FIG. 1 is a diagrammatic view of a conveyor system associated with a high speed printing press.

Referring firstly to FIG. 1, there is shown a high-speed printing press indicated generally and diagrammatically at 10. This receives paper from a reel 12 to produce printed copies 14 which are issued one-after-another by the press and onto a delivery conveyor 16, which takes the successive copies to an automatic stacker indicated at 18. A dump gate 20 is included in this conveyor system and can be dropped to divert the copies to a waste conveyor 21 running underneath. In accordance with this invention, and as will be explained later in this description, when splicing a new reel 13 to the trailing end of reel 12, a metal tab T is attached to the new reel at the splice location. The conveyor system 16 is provided with a dump gate control system shown at 30 in FIG. 1, which serves to control the dump gate via a solenoid actutor 23: the control system 30 is responsive to a proximity detector PS for detecting pass of copies incorporating the tab T and this proximity detector is close to the dump gate 20. The control system is also responsive to a copy count signal taken from a gross counters supply operated by an encoder 22 on the press.

Figure 3:
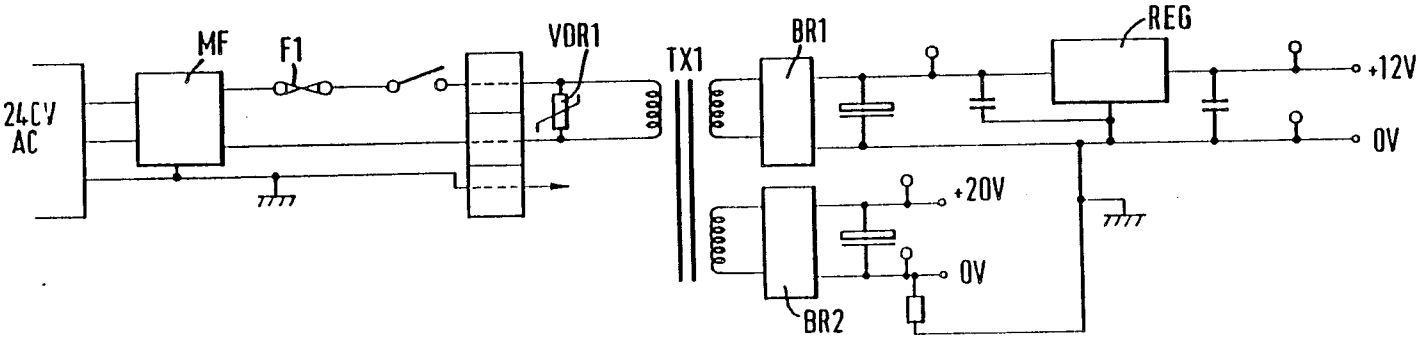
FIG. 3 is a diagram of the power supply arrangements for the control system.

Referring next to the power supply arrangements shown in FIG. 3, the 240 volts a.c. mains supply is applied through a mains filter MF and a fuse F1 to a primary winding of a transformer TX1, a voltage-dependent resistor VDR1 being connected across this primary winding to suppress voltage spikes entering the equipment from the mains. Two secondary windings of the transformer TX1 are connected to respective rectifier bridges BR1, BR2, one of these feeding a voltage regulator REG to provide a 12 volt regulated supply, and the other bridge providing a 20 volt d.c. supply for external inputs.

Figure 2:
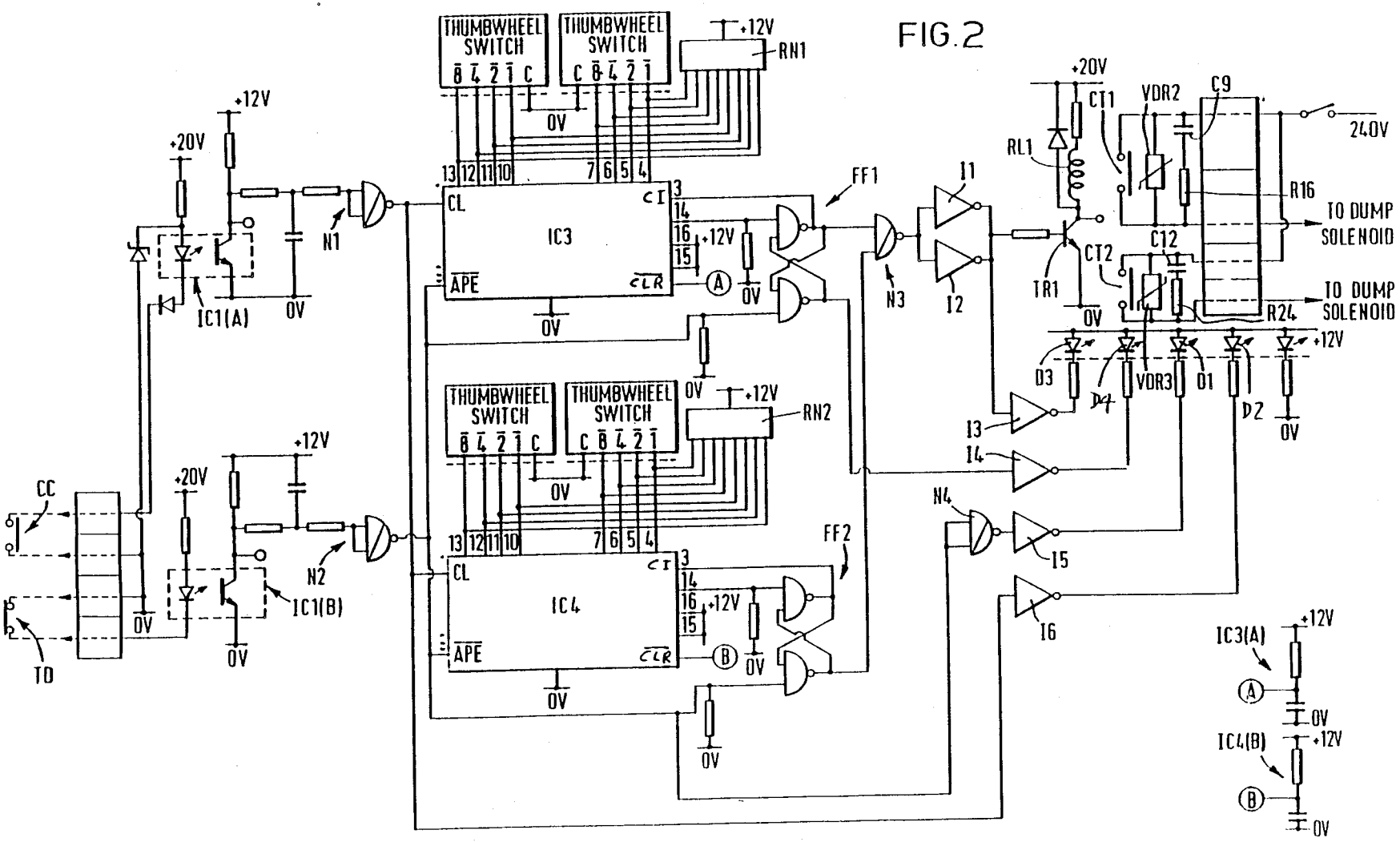
FIG. 2 is a circuit diagram of a dump gate control system in accordance with the invention.

Referring to FIG. 2, the control system comprises two decade, asynchronously presettable, binary-coded-decimal down counters IC3, IC4 (40102 B devices). These serve respectively for a pre-dump count and an end-dump count. Thumbwheel switches TS are provided, on a control console, for each counter and enable the pre-dump and end-dump counts to be preset: if any one of the individual switches is closed, it provides a low on the respective input to the counter IC3 or IC4, otherwise the respective one of a bank of 10K resistors at RN1, RN2 places a high on that respective input.

The copy count signal, derived from the encodeer 22 on the press, serves to close normally-open contacts CC each time a copy is issued by the press, to energise the LED of an opto-isolator IC1(A).

The proximity switch PS serves to detect the arrival of the metal tab in copies passing along the conveyor system 16 from the high-speed printing press 10 to the automatic stacker 18, and cause normally-closed contacts TD to be opened: this causes de-energisation of an opto-isolator IC1(B) and via a NAND gate N2 place a low on an $\overline{\text{APE}}$ input of each counter IC3, IC4 to force the counters to their respective preset counts. A tab-detect indication is given by an LED D1 on the console via a NAND gate N4 and an inverter I5. The opto-isolator IC1(A) provides copy count signals to the counters IC3, IC4 via a NAND gate N1 and each positive transition of this decrements both counters. An LED D2 on the console is energised via an inverter I6 from gate N1 to flash at the count rate.

When pre-dump counter IC3 reaches zero, its output goes low to reset a flip-flop FF1 (which had been set when the $\overline{APE}$ inputs went low), placing a high on the clock-inhibit input CI of counter IC3 thus preventing further decrementing of this counter. Thus flip-flop FF1 provides a "low" to a NAND gate N3 when the tab-detect signal appears and returns this to a "high" after the preset count of IC3 is reached. The status of flip-flop FF1 is indicated by energising an LED D4 on the console via an inverter I4.

The end-dump counter IC4 acts in the same way but the opposite output is taken from its flip-flop FF2: thus a "high" is applied by this flip-flop to gate N3 when the tab-detect signal appears, and a "low" is reapplied when counter IC4 reaches zero. Only when both inputs to NAND N3 are high will its output be low: when the tab-detect signal appears, FF1 provides a low and FF2 a high to keep the output of N3 high. When the end-dump count is reached, FF2 gives a low so that the output of N3 goes high again. Provided the end-dump count is greater than the pre-dump count, then N3 will give a low for the difference between the two counts.

The output of the NAND gate N3 is inverted by two parallel inverters I1,I2 to render a transistor TR1 conductive and energise a relay RL1 in its collector path, when the output of N3 is low. An indication of this state is given by energisation of an LED D3 on the console. The relay coil is fed from the unregulated 20 volt supply to minimise the load on the regulator REG and reduce pickup and fall-out times to minimise contact wear. It will be seen that relay RL1 has contacts CT1, CT2 which are closed upon energisation of the relay, in turn to energise solenoids opening or lowering the dump gate. These normally-open contacts are protected by suppression resistors VDR2, VDR3 and snubber networks C9, R16 and C12, R24 primarily to reduce the possibility of interference entering the system through them.

RC circuits shown at IC3(A), IC4(B) are connected as indicated by CLEAR inputs of the respective counters IC3,IC4 and initialise these counters by holding those inputs low for about half a second while power is being established.

In use of the system, a metal tab T, typically 100 mm by 50 mm, is attached to the new reel of paper 13, during splice preparation in a position that allows it to be detected by the proximity switch PS appropriately positioned on the delivery conveyor 16. The tab T needs to be positioned so as to avoid slitters of the press equipment and to avoid being folded as it passes through the folder of the press. If there are two delivery conveyors issuing from the press, then the two tabs per slice are needed. If tab-positioning is a problem, a number of proximity switches may be positioned across the delivery conveyor 16, and wired in parallel, to ensure that the tab is detected.

In the circuit of FIG. 2, it will be seen that NAND gates N1, N2, N3 and N4 are provided by a single chip (a 4093 device), the two flip-flop FF1, FF2 are formed of two pairs of NAND gates all on a single chip (a 4049 device). Also the opto-isolators are provided by a single chip.

Figure 4:
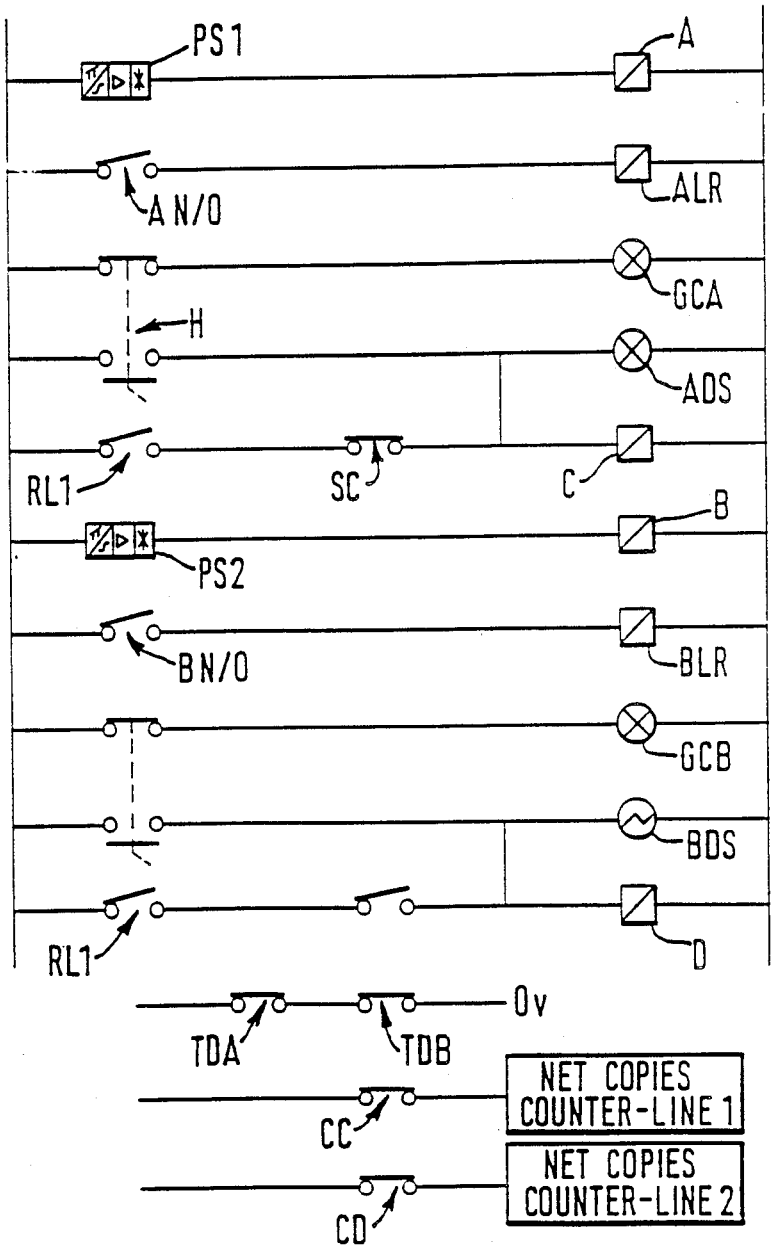
FIG. 4 is a relay diagram of the control system, modified for a two-line conveyor system.

FIG. 4 shows a relay arrangement for a two-line conveyor system. In line 1, the proximity switch PS1, situated as close as possible just upstream of the dump gate, detects the tab, then energises relay A to open contacts TDA and contacts AN/O of this relay are closed to energise a latching relay ALR. When relay RL1 energises in response to opening of contacts TDA, the line 1 dump solenoid ADS is energised until relay RL1 drops out, and during this time the circuit to a "good copy" indicator GCA is interrupted. A relay C is also energised by the relay RL1 contacts via "set" contacts SC of the latching relay and the contacts CC of the relay C open to stop a "net copies" counter for line 1. A manual switch H serves for initiating opening of the dump gate manually if desired. Line 2 is provided with a similar circuit except in operation the latching relay is "reset": the contacts TDA, TDB of the relays A, B are in series (replacing contacts TD in FIG. 1) so either relay will initiate operation of the FIG. 1 circuit.

What is claimed is:

1. In or for a high-speed printing press comprising a plurality of reels, wherein a first of said reels provides paper for said printing press until paper from a second of said reels is joined in a splice to the paper from said first reel, at which time said second reel provides paper to said printing press, said printing press having a conveyor system for carrying printed copy from the press to stacking means and the conveyor system including a dump gate section for rejecting a marred copy containing said splice, a control system for controlling the dump gate section, said control system comprising: detecting means for detecting a marker carried by said marred copy in a succession of printed copies being conveyed by said conveyor system; counter means for starting to count in response to said detecting means; means responsive to each successive printed copy passing a predetermined point along said conveyor system to actuate the counter means; and dump gate actuating means responsive once a predetermined number of said passing printed copies has been counted by said counter means to open the dump gate, and further responsive once a further predetermined number of said printed copies has been counted as passing to close the dump gate.

2. The control sysem as claimed in claim 1, in which said counter means comprises two electronic counters, means responsive to said detecting means to force said counters to rspective preset counts when a said marker is detected, means for then decrementing each counter in response to each said passing printed copy, one said counter controlling said dump gate actuating means to open the dump gate when its count reaches zero and the other said counter controlling said dump gate actuating means to close the dump gate again when its count reaches zero.

3. The control system as claimed in claim 2, in which said counters are each manually presettable.

4. The control system as claimed in claim 2, comprising a flip-flop circuit having means to set said flip-flop circuit in response to said detecting means detecting a said marker and to reset said flip-flop circuit in response to said one counter reaching its count of zero.

5. The control system as claimed in claim 1, comprising opto-isolators coupling said detecting means and said counter actuating means to said counter means.

6. The control system as claimed in claim 1, in which said detecting means comprises a proximity switch for detecting a said marker in the form of a metal tab.

7. A method of controlling a dump gate in a conveyor system of a high speed printing press utilizing a plurality of reels, wherein a first of said reels provides paper for said printing press until paper from a second of said reels is joined in a splice to the paper from said first reel, at which time said second reel provides paper to said printing press, said conveyor system conveying a succession of printed copies from said high speed printing press to stacking means, the method comprising: applying a metal tab at said splice of said first and second reels of paper; detecting the tab on one of a succession of printed copies issuing from the printing press and passing along said conveyor system; starting a count of the printed copies passing after the tab is detected; opening a dump gate in the conveyor system downstream of the point where said tab is detected at a first predetermined count to reject marred printed copies containing said splice; and a closing the dump gate again after a second predetermined count to resume conveying printed copies from said high speed printing press to said stacking means.

8. A control system for controlling a dump gate in a conveyor system for a high speed printing press comprising a plurality of reels, wherein a first of said reels provides paper for said printing press until paper from a second of said reels is joined in a splice to the paper from said first reel, at which time said second reel provides paper to said printing press, said conveyor system conveying a succession of printed copies from said high speed printing press to stacking means, the control system comprising: means for detecting a marker applied at said splice and carried by marred printed copies in said succession of printed copies; counter means for starting to count in response to detection of said marker by said detecting means; means responsive to each successive printed copy passing a predetermined point along said conveyor system to actuate the counter means; and dump gate actuating means responsive once a predetermined number of said passing printed copies has been counted by said counter means to open a dump gate to reject marked printed copies containing said splice, and further responsive once a further predetermined number of passing printed copies has been counted to close the dump gate to resume conveying printed copies from said high speed printing press to said stacking means.

9. In or for a high-speed printing press comprising a plurality of reels, wherein a first of said reels provides paper for said printing press until paper from a second of said reels is joined in a splice to the paper from said first reel, at which time said second reel provides paper to said printing press, said printing press having a conveyor system for carrying printed copies from the press to stacking means and the conveyor system including a dump gate section for rejecting a marred copy containing said splice, a control system for controlling the dump gate section comprising:

detecting means for detecting a marker applied at said splice and carried by said marred copy in a succession of printed copies being conveyed by said conveyor system;

counter means for starting to count in response to detection of said marker by said detecting means, said counter means comprising two electronic counters, means responsive to said detecting means to force said counters to respective preset counts when said marker is detected, means for then decrementing each counter in response to each said passing printed copy, one of said counters controlling dump gate actuating means to open the dump gate when its count reaches zero and the other of said counters controlling said dump gate actuating means to close the dump gate again when its count reaches zero;

a first flip-flop circuit having means to set said first flip-flop circuit in response to said detecting means detecting said marker and to reset said first flip-flop circuit in response to said one counter reaching its count of zero; and a second flip-flop circuit having means to set said second flip-flop circuit in response to said detecting means detecting said marker and to reset said second flip-flop circuit in response to said other counter reaching its count of zero.

10. The control system as claimed in claim 9, further comprising a logic gate connected to said flip-flop circuits to provide a signal only whilst the first flip-flop circuit is reset and the second flip-flop circuit is set, said signal being applied to the dump gate actuating means to open, and hold open, the dump gate.

* * * * *